United States Patent [19]

Bensberg

[11] Patent Number: 4,988,330

[45] Date of Patent: Jan. 29, 1991

[54] MACHINE FOR AND METHOD OF MANUFACTURING FOLDED CONTAINERS

[75] Inventor: Wolfgang Bensberg, Düsseldorf, Fed. Rep. of Germany

[73] Assignee: Jagenberg Aktiengesellschaft, Dusseldorf, Fed. Rep. of Germany

[21] Appl. No.: 288,510

[22] Filed: Dec. 22, 1988

[30] Foreign Application Priority Data

Dec. 23, 1987 [DE] Fed. Rep. of Germany ..... 3743728

[51] Int. Cl.[5] ..... B31B 3/62; B31B 5/64; B31B 3/36

[52] U.S. Cl. ..... 493/16; 493/6; 493/11; 493/21; 493/28; 493/36; 493/142

[58] Field of Search ..... 493/1, 2, 3, 6, 7, 11, 493/12, 16, 21, 23, 27, 28, 29, 35, 36, 122, 126, 127, 141, 142, 480

[56] References Cited

U.S. PATENT DOCUMENTS

| | | | |
|---|---|---|---|
| 955,221 | 4/1910 | Stilwell | 493/16 |
| 1,986,023 | 1/1935 | Staude | 493/142 |
| 3,309,968 | 3/1967 | Scully | 493/12 |
| 3,741,081 | 6/1973 | Lutz | 493/12 |
| 4,349,998 | 9/1982 | Covert | 493/16 |
| 4,673,381 | 6/1987 | Yamamoto et al. | 493/142 |

FOREIGN PATENT DOCUMENTS

| | | | |
|---|---|---|---|
| 1297457 | 6/1969 | Fed. Rep. of Germany | 493/16 |
| 2647437 | 12/1977 | Fed. Rep. of Germany | 493/12 |

*Primary Examiner*—William E. Terrell

*Attorney, Agent, or Firm*—Sprung Horn Kramer & Woods

[57] ABSTRACT

A machine for and a method of manufacturing folded containers, especially folded blanks. The machine has a mechanism for applying adhesive, a folding station, and a pressure-application station with pressure-application mechanisms for forcing the adhesive-coated seams together to seal them. The invention ensures that, when the machine is stopped, all the blanks to which adhesive has been applied but which have not yet been folded to form sealed seams are automatically marked or rejected. The machine has both a marking or rejecting mechanism downstream of the pressure-application station and computerized controls that, when the machine is stopped, determine the number of folded blanks in the production line between the adhesive-application mechanism and a first pressure-application mechanism in the pressure-application station and, once the machine is started again, control the marking or rejecting mechanism.

2 Claims, 1 Drawing Sheet

MACHINE FOR AND METHOD OF MANUFACTURING FOLDED CONTAINERS

BACKGROUND OF THE INVENTION

The invention relates, first, to a machine for manufacturing folded containers, especially folded carton blanks, with a mechanism for applying adhesive, a folding station, and a pressure-application station with pressure-application mechanisms for forcing the adhesive-coated seams together to seal them and, second, to a method of manufacturing folded cartons with a machine in accordance with the invention.

Machines of this type are known and are described in the Jagenberg AG brochure Description of the High Speed Folding Carton Gluer DIANA 40-1/70/1/90-1, Infotec I/157, 7/86.

Stopping a folded-blank gluing machine entails a problem in that the adhesive that has already been applied to the blanks in the production line between the adhesive-application mechanism and the first pressure-application mechanism in the pressure-application station dries while the machine is down. If the down time exceeds a specific limit, the adhesive-coated seams will not be tight, and the blanks must be rejected.

Some folded-blank gluing machines have a code reader to detect defective blanks and a rejecting mechanism between the folding station and the pressure-application station. Removing the blanks with adhesive-coated but not yet sealed seams from the production line between the adhesive-application mechanism and the rejecting mechanism by manually pressing a rejection button when a machine of this type has been stopped is known.

A drawback to this solution is that the blanks must be rejected manually, and the blanks between the rejecting mechanism and the first pressure-application mechanism in the pressure-application station do not get rejected.

OBJECT OF THE INVENTION

One object of the invention is to improve such a machine to the extent that, when it is stopped, all the blanks with adhesive-coated but not yet sealed seams can be automatically marked or rejected.

Another object of the invention is to provide a method of manufacturing folded blanks with a machine in accordance with the invention.

The first object is attained in accordance with the invention by the improvement comprising both a marking or rejecting mechanism downstream of the pressure-application station and computerized controls which, when the machine is stopped, determine the number of folded blanks in the production line between the adhesive-application mechanism and the first pressure-application mechanism in the pressure-application station and, once the machine is started again, control the marking or rejecting mechanism.

A preferred embodiment of the machine in accordance with the invention can have a transitional station with a mechanism for establishing a stream of overlapping folded blanks between the folding station and the pressure-application station. An embodiment of this kind can have an individual-blank rejecting mechanism in the vicinity of the transitional station and controlled by the computerized controls. The marking or rejecting mechanism can be a baffle for the overlapping blanks. The same embodiment can have both a mechanism for separating the overlapping blanks downstream of the pressure-application station and a rejecting mechanism downstream of the blank-separating mechanism. The embodiment can also have another mechanism for reestablishing a stream of overlapping folded blanks downstream of the individual-blank rejecting mechanism and controlled by the computerized controls.

A second object is attained in accordance with the invention by the improvement wherein, when the machine is stopped, the computerized controls determine the number of blanks with adhesive-coated but not yet sealed seams between the adhesive-application mechanism and the first pressure-application mechanism in the pressure-application station, calculate the length of the associated stream of overlapping blanks therefrom, and, subsequent to a delay or to a distance traveled that corresponds to the time it takes to transport the blanks from the point at which they enter the pressure-application station and the point at which they enter the marking or rejecting mechanism or to the distance between those two points, activate the marking or rejecting mechanism for a period or a distance that corresponds to the time it takes to convey a stream of overlapping blanks of the calculated length or to the distance over which it must travel.

When the method is employed with the aforesaid preferred embodiment, the computerized controls can, when the machine is stopped, determine both the number of blanks between the adhesive-application mechanism and the individual-blank rejecting mechanism and the number of blanks between the individual-blank rejecting mechanism and the first pressure-application mechanism in the pressure-application station along with the associated length of the stream of overlapping blanks and, when the machine is started again, immediately activate the individual-blank rejecting mechanism to reject the first number of blanks and, subsequent to a delay or to a distance traveled that corresponds to the time it takes to transport the blanks from the point at which they enter the pressure-application station and the point at which they enter the marking or rejecting mechanism or to the distance between those two points, activate the marking or rejecting mechanism for a period or a distance that corresponds to the time it takes to convey the second number of blanks to the distance over which they must travel.

BRIEF DESCRIPTION OF THE DRAWING

The figure is a side view of a folded-blank gluing machine in accordance with the invention.

DETAILED DESCRIPTION OF THE INVENTION

Figure 1:
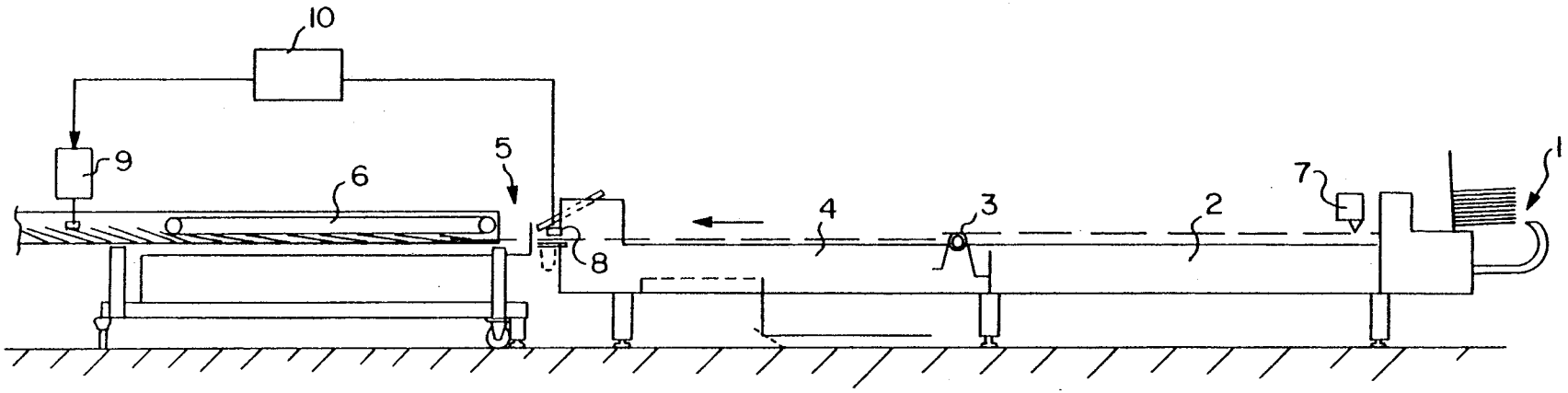

The folded-blank gluing machine has, along the direction in which the blanks travel, a blank infeed 1, a fold-determination mechanism 2, an adhesive-application mechanism 3, a folding station 4, a transitional station 5, and a pressure-application station 6. The blanks are conveyed individually and one after another at a slight distance apart through fold-determination mechanism 2 and folding station 4 by pulley-supported revolving conveyor belts to transitional station 5, whence they are supplied overlapped by an upper and lower belt to pressure-application station 6. Each pressure-application mechanism in pressure-application station 6 comprises a wide upper pressure-application belt and a continuous lower pressure-application belt, each traveling around driven rollers and resting against pressure-application rollers.

There is a code reader 7 in the vicinity of blank infeed 1 and a rejecting mechanism 8 that detects and rejects defective blanks in the vicinity of transitional station 4.

Adjacent to pressure-application station 6 is a marking mechanism 9 that is controlled by computerized controls 10. Computerized controls 10 are also connected to rejecting mechanism 8, which they can activate. The marking mechanism 9 in the present embodiment comprises a magnetically activated lever that laterally displaces a blank out of the stream of overlapping blanks when the mechanism receives a signal from computerized controls 10. Instead of marking mechanism 9 it is also possible to employ a baffle that separates a corresponding number of blanks out of the stream in response to a signal from computerized controls 10. It is also possible to separate the blanks again downstream of the pressure-application station and to position an individual-blank rejecting mechanism at that point.

The instant embodiment features a mechanism, double belts traveling at a reduced speed for example, for reestablishing a continuous stream of overlapping blanks downstream of the individual-blank rejection mechanism. The overlapping-blank stream-reestablishing mechanism is disengaged by computerized controls 10 when, due to the operation of one or both rejection mechanisms, no blanks are arriving. A stream of overlapping blanks with no gaps is accordingly established at the exit from the machine and can be further processed, packaged for instance, with no problems.

The folded-blank gluing machine in accordance with the invention operates as follows:

The blanks are inserted between conveyor belts by blank infeed 1, and the eventual folds are established along their scores by fold-determination mechanism 2. Adhesive is applied along the seams by adhesive-application mechanism 3, and the blanks are folded by the folding mechanisms, roller-supported belts in the instant embodiment, in folding station 4. Any blanks determined to be defective by code reader 7 are rejected by rejecting mechanism 8 in transitional station 5. The rejecting mechanism comprises a turntable on which the blanks that are to be rejected are subjected to pressure from magnetically controlled deflection rollers and accordingly eliminated from the stream of blanks.

From transitional station 5 the blanks are transferred to the slower-moving pressure-application belts in pressure-application station 6 and, due to the difference in speed, overlapped. The extent of overlap can be controlled by an adjusting device. The blanks then travel overlapped through pressure-application station 6, where they are sealed under pressure. Upon leaving pressure-application station 6, the blanks are supplied by an unillustrated conveyor to a packaging station or for further processing.

When the machine is stopped longer than a prescribable time, computerized controls 10 determine from the operating parameters (length of blank, distance traveled, rate of travel, and degree of overlap) the numbers of blanks between adhesive-application mechanism 3 and rejecting mechanism 8 and between rejecting mechanism 8 and the first pressure-application mechanism in pressure-application station 6. Once the machine is started again, computerized controls 10 immediately activate rejecting mechanism 8, which rejects the calculated number of blanks with adhesive-coated but not yet sealed seams, up to the blank that was in adhesive-application mechanism 3 when the machine was stopped.

The mechanisms in the instant embodiment are controlled as a function of speed by way of path-length signals at a constant distance of travel as counted by pulse counters mounted on rotating conveying mechanisms, pulleys for instance. A specific distance traveled accordingly corresponds to a specific number of path-length signals. To mark the blanks between rejecting mechanism 8 and the first pressure-application mechanism in pressure-application station 6, computerized controls 10 calculate the number of path-length signals necessary to convey the first unsealed blank as far as marking mechanism 9. The controls also calculate the number of unoverlapped blanks entering the stream of overlapped blanks through transitional station 5 downstream of rejecting mechanism 8 and add it to the number of overlapped blanks upstream of pressure-application station 6. The number of associated path-length signals is calculated from the sum of the lengths of the two streams of overlapping blanks.

Once the machine is turned on again, computerized controls 10 activate marking mechanism 9 as soon as the path-length signals necessary for conveying the blanks from the beginning of pressure-application station 6 to marking mechanism 9 have been counted. Marking mechanism 9 then laterally displaces the first still unsealed blank out of the flow of overlapping blanks, accordingly marking it. Marking mechanism 9 is activated a second time when the number of path-length signals calculated in accordance with the sum of the lengths of the streams of overlapping blanks has been counted, marking the last blank to have adhesive applied to it before the machine was stopped.

In the present embodiment, the flow of overlapping blanks between the marked blanks is then removed manually. It is also possible to remove them automatically with a baffle or individual-blank rejecting mechanism governed by computerized controls 10.

When there is no rejecting mechanism in the vicinity of transitional station 5, computerized controls 10 calculate the corresponding length of the stream of over-lapping blanks from the number of blanks in the vicinity of adhesive-application mechanism 3 and transitional station 5 and add it to the length of the stream of overlapping blanks upstream of the first pressure-application mechanism. In this embodiment, the blanks with the adhesive-coated seams are also marked or removed from folding station 4 and transitional station 5 downstream of pressure-application station 6.

Instead of controlling the mechanisms with path-length signals, it is also possible to control them by way of conveying times. In this case, the conveying times are calculated by computerized controls 10 as a function of the speed at which the pressure-application belts travel and of the length of the path traveled from the beginning of the pressure-application belt to marking or rejecting mechanism 9.

Although folded cardboard-blank gluing machines represent the preferred field of application for the invention, it can also be employed with machines that manufacture polyethylene-coated containers with seams that are sealed with combination of heat and pressure.

It is understood that the specification and examples are illustrative but not limitative of the present invention and that other embodiments within the spirit and scope of the invention will suggest themselves to those skilled in the art.

What is claimed is:

1. In a method of manufacturing a stream of folded containers in an apparatus including a marking or rejecting station to mark blanks for rejection or to reject blanks in response to the calculated length, the method comprising applying adhesive to a continuous stream of spaced container blanks, folding the blanks, overlapping the blanks in the stream, applying pressure to form the blanks into containers, passing the blanks through the marking or rejecting station, and interrupting the method from time to time, the improvement which comprises after each interruption determining the number of containers to which adhesive has been applied but to which pressure has not yet been applied before such interruption, calculating the length of the associated stream of overlapping blanks therefrom, and, subsequent to a delay that corresponds to the time it takes to transport the blanks from the point at which they enter the pressure-application location and the point at which blank enters the marking or rejecting station, activating the marking or rejecting mechanisms for a period that corresponds to the time it takes to convey a stream of overlapping blanks of the calculated length.

2. In a method of manufacturing a stream of folded containers in an apparatus including a marking or rejecting station to mark blanks for rejection or to reject blanks in response to the calculated length, the method comprising applying adhesive to a continuous stream of spaced container blanks, folding the blanks, overlapping the blanks in the stream, applying pressure to form the blanks into containers, passing the blanks through the marking or rejecting station, and interrupting the method from time to time, the improvement which comprises after each interruption determining the number of containers to which adhesive has been applied but to which pressure has not yet been applied before such interruption, calculating the length of the associated stream of overlapping blanks therefrom, and, subsequent to a delay that corresponds to the distance between the point at which a blank enters the pressure-application location and the point at which blank enters the marking or rejecting station, activating the marking or rejecting mechanisms for a period that corresponds to the time it takes to convey a stream of overlapping blanks of the calculated length.

* * * * *